US007171710B2

(12) United States Patent
Mann

(10) Patent No.: US 7,171,710 B2
(45) Date of Patent: Feb. 6, 2007

(54) SYSTEM HAVING A TILTABLE SLEEPING SURFACE AND METHOD FOR PREVENTING POSITIONAL PLAGIOCEPHALY

(76) Inventor: Robert J. Mann, 671 Manhattan Road SE., East Grand Rapids, MI (US) 49508

( * ) Notice: Subject to any disclaimer, the term of this patent is extended or adjusted under 35 U.S.C. 154(b) by 0 days.

(21) Appl. No.: 10/947,495

(22) Filed: Sep. 22, 2004

(65) Prior Publication Data

US 2005/0034239 A1 Feb. 17, 2005

Related U.S. Application Data

(60) Continuation-in-part of application No. 10/200,765, filed on Jul. 23, 2002, which is a continuation-in-part of application No. 09/907,142, filed on Jul. 17, 2001, now Pat. No. 6,421,855, which is a division of application No. 09/429,423, filed on Oct. 28, 1999, now Pat. No. 6,260,553.

(51) Int. Cl.
*A47C 20/08* (2006.01)
*A47D 13/08* (2006.01)

(52) U.S. Cl. ..... 5/655; 5/632; 5/633; 5/657

(58) Field of Classification Search ..... 5/615, 5/509.1, 660, 715, 655, 632, 633; 128/845
See application file for complete search history.

(56) References Cited

U.S. PATENT DOCUMENTS 1,021,335 A 3/1912 Robinson
2,462,579 A 2/1949 Warner
2,710,052 A 6/1955 Witmer
3,013,281 A 12/1961 Steiner
3,462,777 A 8/1969 Lutsky
3,795,021 A 3/1974 Moniot
3,806,110 A 4/1974 Glasser et al.
4,733,836 A * 3/1988 Barnes ..... 248/106
4,862,535 A 9/1989 Roberts
4,934,002 A * 6/1990 Watanabe ..... 5/607
4,962,553 A 10/1990 Marquis
5,014,376 A * 5/1991 Doran et al. ..... 5/603
5,208,925 A 5/1993 Edlund
5,341,531 A * 8/1994 Straub et al. ..... 5/655
5,416,939 A 5/1995 Maalouli
5,535,464 A 7/1996 Salonica
5,640,729 A 6/1997 Marino
5,699,569 A * 12/1997 Schwarz-Zohrer ..... 5/655
5,738,640 A 4/1998 Carlson-Orsi
5,953,749 A 9/1999 Backs (Continued)

OTHER PUBLICATIONS

Non-Final Office Action mailed Nov. 10, 2005, for U.S. Appl. No. 10/200,765.

(Continued)

*Primary Examiner*—Michael Trettel
(74) *Attorney, Agent, or Firm*—Price, Heneveld, Cooper, DeWitt & Litton, LLP

(57) ABSTRACT

A system used for the prevention of positional plagiocephaly in which an infant receiving member includes an infant supporting surface, a first portion, and a second portion. An inclined member is positioned at least partially under the first portion of the infant receiving surface such that the first portion of the infant receiving surface is inclined.

31 Claims, 4 Drawing Sheets

U.S. PATENT DOCUMENTS

| | | | | |
|---|---|---|---|---|
| 6,006,381 | A | 12/1999 | Tandrup | |
| 6,052,849 | A | 4/2000 | Dixon et al. | |
| 6,125,487 | A | 10/2000 | Ive | |
| 6,154,900 | A * | 12/2000 | Shaw | 5/81.1 R |
| 6,260,553 | B1 | 7/2001 | Mann | |
| 6,334,442 | B1 | 1/2002 | Altamura | |
| 6,371,119 | B1 | 4/2002 | Zadini et al. | |
| 6,421,855 | B2 | 7/2002 | Mann | |
| 6,460,207 | B1 | 10/2002 | Papay et al. | |
| 6,473,923 | B1 | 11/2002 | Straub | |
| 6,622,324 | B2 | 9/2003 | VanSteenburg et al. | |
| 6,671,907 | B1 | 1/2004 | Zuberi | |
| 6,708,354 | B1 | 3/2004 | Carter et al. | |
| 6,877,176 | B2 * | 4/2005 | Houghteling | 5/655 |
| 6,954,954 | B2 * | 10/2005 | Stelnicki | 5/655 |
| 2002/0174488 | A1 | 11/2002 | Appleton | |
| 2003/0033674 | A1 | 2/2003 | Mann | |

OTHER PUBLICATIONS

"One Step Ahead" online store reference, copyright 2001, pp. 1-6.

* cited by examiner

SYSTEM HAVING A TILTABLE SLEEPING SURFACE AND METHOD FOR PREVENTING POSITIONAL PLAGIOCEPHALY

CROSS-REFERENCE TO RELATED APPLICATIONS

This application claims priority to and is a continuation in part of U.S. patent application Ser. No. 10/200,765, filed on Jul. 23, 2002, still pending entitled "INFANT GARMENT AND METHODS FOR TREATING POSITIONAL PLAGIOCEPHALY," by Robert J. Mann, which is a continuation-in-part of U.S. patent application Ser. No. 09/907,142, filed on Jul. 17, 2001, now U.S. Pat. No. 6,421,855, entitled "INFANT BED HAVING A TILTABLE SLEEPING SURFACE FOR TREATING AND PREVENTION OF POSITIONAL PLAGIOCEPHALY," by Robert J. Mann, which is a divisional of U.S. patent application Ser. No. 09/429,423, now U.S. Pat. No. 6,260,553, entitled "INFANT BED HAVING A TILTABLE SLEEPING SURFACE AND METHOD OF TREATING POSITIONAL PLAGIOCEPHALY," filed on Oct. 28, 1999, by Robert J. Mann, the entire disclosures of each of these applications referenced above are incorporated herein by reference.

BACKGROUND OF THE INVENTION

The present invention generally relates to a system for preventing positional plagiocephaly, and more particularly to a system for preventing positional plagiocephaly in infants while they sleep. The present invention also relates to a method for the prevention of positional plagiocephaly.

Sudden Infant Death Syndrome (SIDS) is a devastating problem with no known cause. The American Academy of Pediatrics recommended years ago that babies should sleep on their backs on the assumption that part of the SIDS problem might be related to infants suffocating face down in their cribs. The Back to Sleep program began nationwide, and the results have been analyzed. A clear statistical reduction in SIDS deaths occurred after the program was installed.

Some time after the program started, doctors began seeing an increasing number of babies with distorted heads. A number were treated with extensive surgery. Later, it became clear that the distortion, mostly flatness of the back and side of the head, was a direct result of the sleeping position. The weight of the brain on the thin skull bone changes the growth rate, and a progressive deformity occurs for the first four to six months of life. Once infants have a flat spot on their skull, the flatness becomes exacerbated due to the inability of the infants to move their heads once lying on the flat spot due to the general weakness all infants exhibit in their necks.

Historically, several cultures experienced similar positional distortions. The Plains American Indians, by strapping infants to a cradle board, caused uniform flatness of the back of the head. The present condition of positional plagiocephaly causes similar skull and neck distortions.

Therapeutic programs to correct the distortion developed, including physical therapy and helmet molding or pressure relief programs. These programs assist some in the correction of the several characteristic shape presentations.

To date, only presumptive circumstances can be used as predictors as to which babies will develop the deformity (large males, twins, and preemies).

SUMMARY OF THE INVENTION

In one embodiment of the present invention, a system for the prevention of positional plagiocephaly includes an infant receiving member comprising an infant supporting surface, a first portion and a second portion. An inclined member is positioned at least partially under the first portion of the infant receiving surface such that the first portion of the infant receiving surface is inclined.

Another embodiment of the present invention includes a system for the prevention of positional plagiocephaly, including a mattress comprising a first portion, a second portion and an infant receiving region located substantially adjacent the second portion and the first portion of the mattress. A three point harness is typically adapted to retain an infant in the infant receiving region of the mattress. A foam wedge is adapted to be positioned at least partially under either the first portion or the second portion of the mattress such that an infant's head is directed to lay in a substantially different lateral position when the edge is at least partially positioned under the first portion and when the wedge is at least partially positioned under the second portion.

In another aspect of the present invention, a method for the prevention of positional plagiocephaly includes the steps of: (a) providing an infant receiving member that typically includes an infant supporting surface, a first portion, a second portion, an infant receiving region located substantially adjacent the second portion and the first portion of the infant receiving member, an infant retaining device adapted to retain an infant at the infant receiving region of the infant receiving member and an inclined member; (b) positioning the infant receiving member on a generally horizontal surface; (c) positioning the inclined member at least partially under the first portion of the infant receiving device, thereby at least partially tilting the first portion of the infant receiving device; (d) positioning an infant in the infant retaining device whereby the tilt of the first portion forces the infant's head into a first position; and (e) securing the infant in the infant retaining device.

In still another aspect of the present invention, a method for the prevention of positional plagiocephaly includes the steps of: (a) providing a mattress comprising an infant supporting surface, a first portion, a second portion, an infant receiving region located substantially adjacent the second portion and the first portion of the mattress, a harness adapted to retain an infant at the infant receiving region and a generally V-shaped inclined member; (b) positioning the mattress on a generally horizontal surface; (c) positioning the inclined member at least partially under the first portion of the mattress, thereby at least partially tilting the first portion of the mattress; (d) positioning an infant in the harness whereby the tilt of the first portion urges the infant's head into a first substantially lateral position; and (e) securing the infant in the harness.

These and other features, advantages and objects of the present invention will be further understood and appreciated by those skilled in the art by reference to the following specification, claims and appended drawings.

Figure 1:
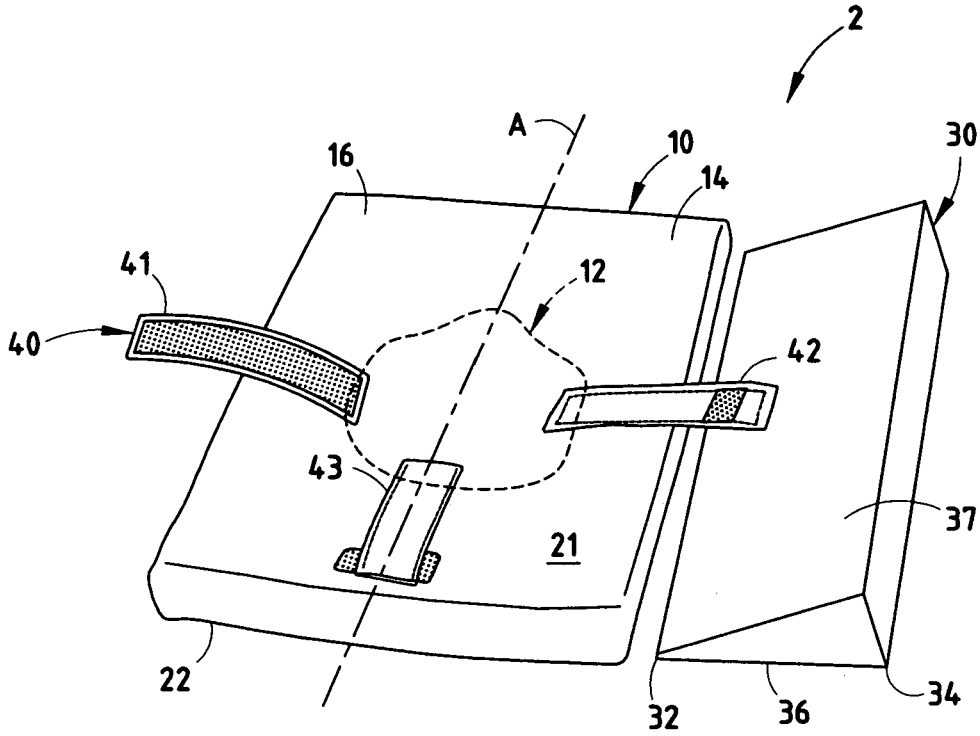
FIG. 1 is an exploded perspective view of the system constructed in accordance with an embodiment of the present invention.

The drawings illustrated herein form a part of this specification. However, where the drawings show phantom or broken lines, the subject matter which is disclosed by the broken lines does not form a part of the inventive concept.

DETAILED DESCRIPTION OF THE PREFERRED EMBODIMENTS

As mentioned above and explained in more detail below, the present invention relates to a system and a method of preventing positional plagiocephaly in infants. In general, a system 2 includes an infant receiving member 10, which includes an infant supporting surface 12, a first portion 14, and a second portion 16. Further, an inclined member 30 is typically at least partially positioned under either the first portion 14 or the second portion 16 of the infant receiving member 10 such that either the first portion 14 or the second portion 16 is inclined.

As shown in FIG. 1, the infant receiving member 10 is typically any generally planar article or material capable of supporting an infant. In one embodiment, infant receiving member 10 is a generally rectangular mattress capable of comfortably supporting an infant. The term "mattress" is not intended to be defined as including or being limited to a specific material or materials. Instead, the term "mattress" shall include any material or combination thereof, which is capable of either independently or in combination with other surfaces, supporting an infant thereon. The material of which infant receiving member 10 is typically fabricated from is not critical to the inventive concept and any material or shape thereof may be used. However, the material is typically at least partially deformable such that it forms an inclined portion when inclined member 30 is placed at least partially under it. In one embodiment, a generally rectangular foam material is used. Further, the infant receiving member 10 may be covered (not shown) with a covering, such as a sheet or other covering material. As will be discussed in greater detail later, the covering material may include pockets for receiving inclined member 30. Infant receiving member 10 also includes an infant supporting surface 12 generally centrally disposed thereon. Infant supporting surface 12 generally includes a substantially central area that typically includes a harness 40 (discussed below). Of course, infant supporting surface 12 along with harness 40 may be disposed anywhere on or within infant receiving member 10. Infant receiving member 10 also typically has a first portion 14 and a second portion 16. The first and second portions 14 and 16, respectively, divide the infant receiving member 10 into two portions, typically two substantially symmetrical portions. Typically, the first and second portions are drawn about a longitudinal axis of infant receiving member 10 as indicated in FIG. 1 as axis A.

Figure 2:
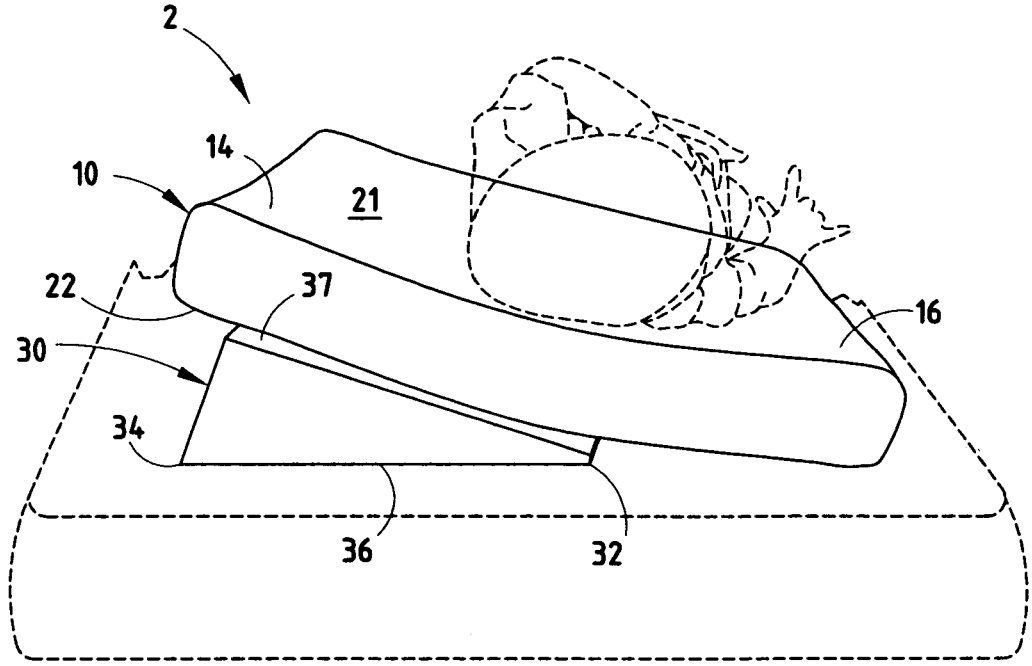
FIG. 2 is an end view of the system in accordance with an embodiment with an infant positioned therein.

Inclined member 30 is typically disposed adjacent back surface 22 of infant receiving member 10 to incline, tilt, or otherwise "prop up" either first or second portion 14 or 16, as illustrated by FIG. 2. Inclined member 30 may be fabricated from various materials and in various geometrical shapes. However, inclined member 30 is typically a generally V-shaped member, including a first substantially pointed end 32 and a second substantially truncated end 34. Most typically, the inclined member 30 is made from a foam material, typically a urethane type foam, but the inclined wedge member can be made from other materials, such as metal, wood, or plastic. Inclined member 30 may also be covered with any suitable covering.

Figure 3:
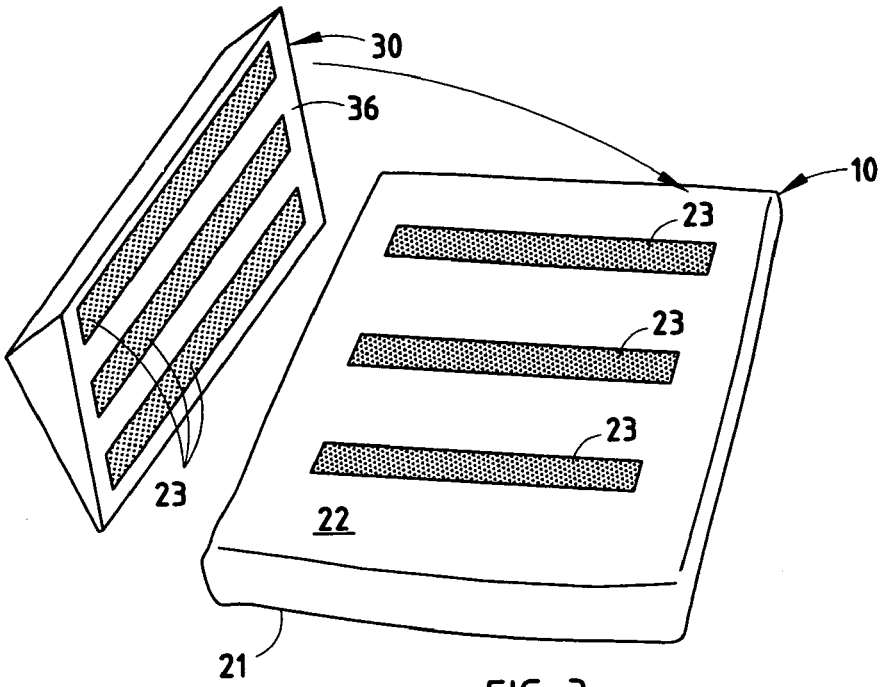
FIG. 3 is an exploded rear perspective view of a system constructed in accordance with another embodiment.

When inclined member 30 is disposed at least substantially adjacent back surface 22, as illustrated in FIG. 2, the inclined member 30 may optionally be affixed thereto. The inclined member 30 may be affixed using any known method, but typically is affixed using a hook and loop style attachment system, as illustrated in FIG. 3, wherein back surface 22 of infant receiving member 10 may contain one of the hook or loop parts of the hook and loop attachment system, and a first or a second surface 36 or 37 of inclined member 30 may contain the corresponding loop or hook parts of the hook and loop style attachment system. The above-mentioned hook and loop style fastening or attaching system is meant to describe any conventional hook and loop fastening system. These systems generally work by having the hook or loop portion entangling or interlocking in the corresponding loop or hook portion of the system. Although the term "Velcro™" is frequently misused to describe the hook and loop style fastening system and further may be used, the invention is not meant to be limited to the specific characteristics of Velcro™.

Figure 4:
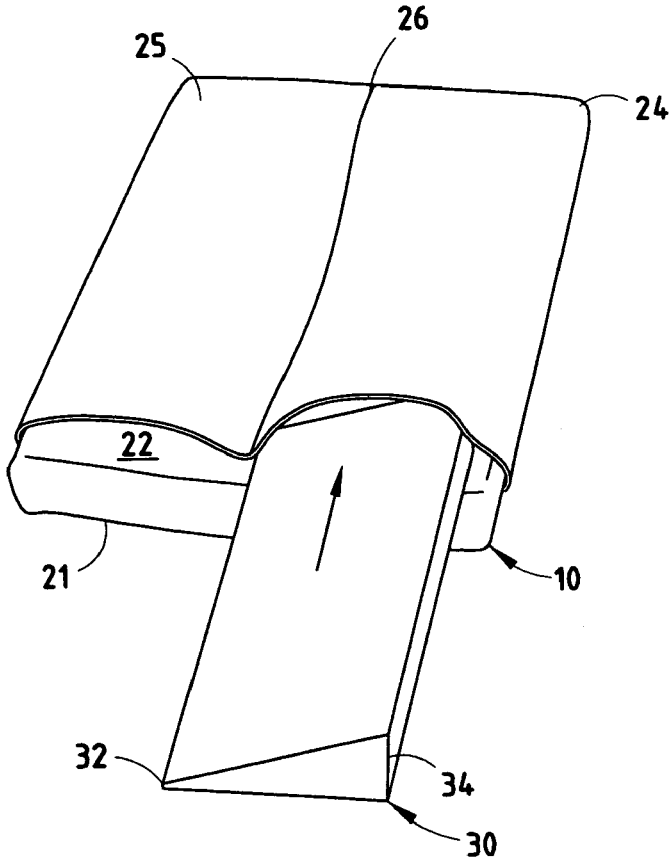
FIG. 4 is a rear perspective view of a system being assembled and constructed in accordance with yet another embodiment.

FIG. 4 illustrates another embodiment, wherein inclined member 30 may be disposed or otherwise retained within a first pocket 24 or a second pocket 25. In this configuration, inclined member 30 is typically retained against or in close proximity to back surface 22 by sliding inclined member 30 into one of pockets 24 or 25. Although not meant to be limiting, in one embodiment, pockets 24 and 25 are divided by a typically central divider 26 typically substantially disposed along the longitudinal axis of infant receiving member 10. In FIG. 4, divider 26 is shown created by stitching or otherwise engaging a material to back surface 22, thereby creating first and second pockets 24 and 25. Conceivably, this engagement could also be accomplished using a hook and loop fastener system as described above. The material and the manner of creating a plurality of pockets are not critical to the inventive concept and numerous known methods and materials may be used. Still further, a single pocket, a pair of pockets, or any plurality thereof may be used.

Figure 5:
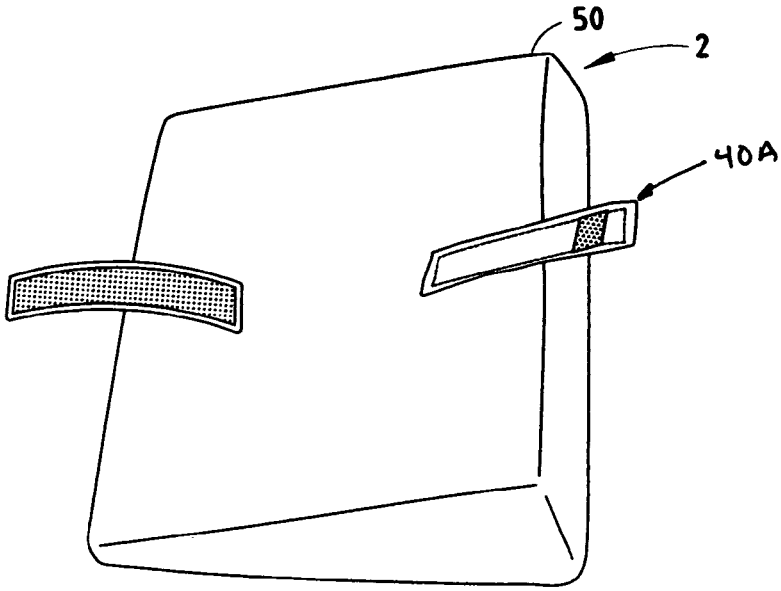
FIG. 5 is a perspective view of a system constructed in accordance with an embodiment showing a two strap infant restraining device.

As shown in FIG. 5, inclined member 30 may be fabricated to be an integral part of infant receiving member 10 to form inclined infant receiving member 50. Alternatively, inclined member 30 may itself be an infant receiving member.

Figure 6:
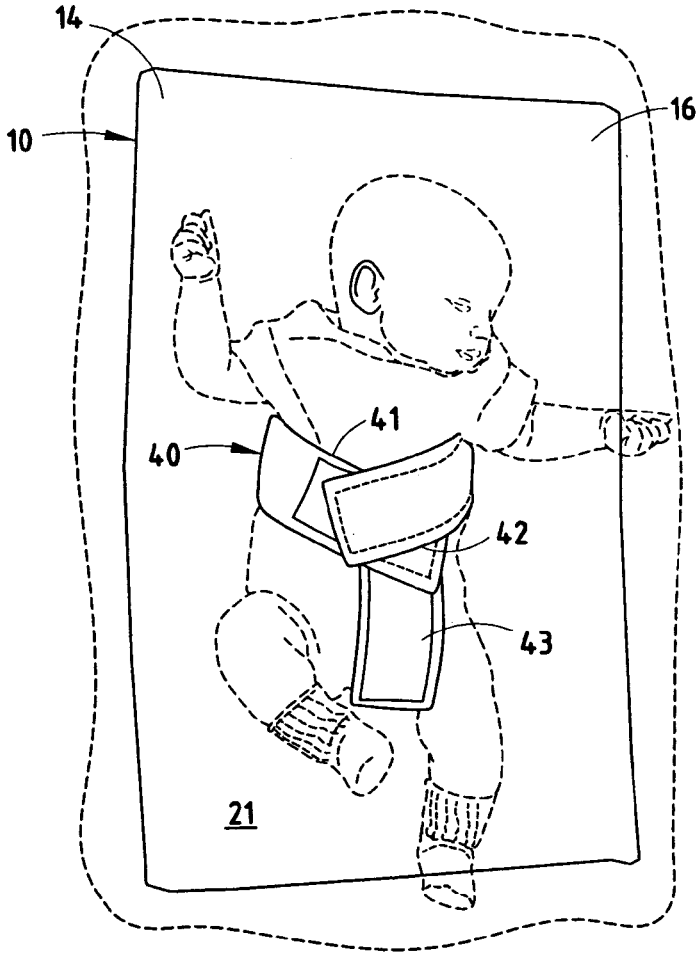
FIG. 6 is a top view of the system of FIG. 2.

Harness 40 is typically utilized to secure an infant to infant receiving member 10, thereby preventing the infant from rolling over or otherwise rolling down the inclined surface of the system 2. As illustrated in FIG. 1, a three point harness may be used, wherein a first strap and a second strap laterally wrap over the torso of an infant and engage one another, while a third strap, substantially longitudinally, wraps over the torso of an infant and engages either the first or second strap, thereby securing the infant (FIG. 6). Additionally, a hook and loop style fastening system is typically utilized to secure the straps. Although, any fastening system which is generally well-known within the art may be utilized. Another embodiment is shown in FIG. 5, wherein the harness 40A includes a pair of straps. Further it is envisioned that a single strap could be used. Alternatively, more than three straps may also be used.

As described previously, the method of preventing positional plagiocephaly may be practiced using the inventive system. Broadly speaking, the method utilizes a system constructed in accordance with the present invention and comprises alternately tilting sideways a portion of the infant receiving member on which at least a portion of the infant is laid such that by tilting the portion of the infant receiving member underlying the infant, sideways, the infant will sleep with his/her head facing down the slope of the tilted mattress portion (FIG. 2). Because the infant generally lacks the muscles to move its head to sleep on the other side of its head, against the slope of the mattress, the infant will not sleep on the other side of its head. In this manner, the infant will sleep to one side of its head one night, and, when the infant is differently positioned or the inclined member positioned under the opposite portion of the infant receiving member, the infant will sleep on the other side of its head. By alternating the side of the infant's head on which the infant sleeps each night, or on some other periodic basis, the infant will not develop the flat spots in its skull that are symptomatic of positional plagiocephaly. The steps of tilting the head portion of the mattress to different sides every other night should be continued through about the first four to ten months after the infant's due date. Infants that are born premature or are neurologically impaired may be susceptible to a greater age.

Figure 7:
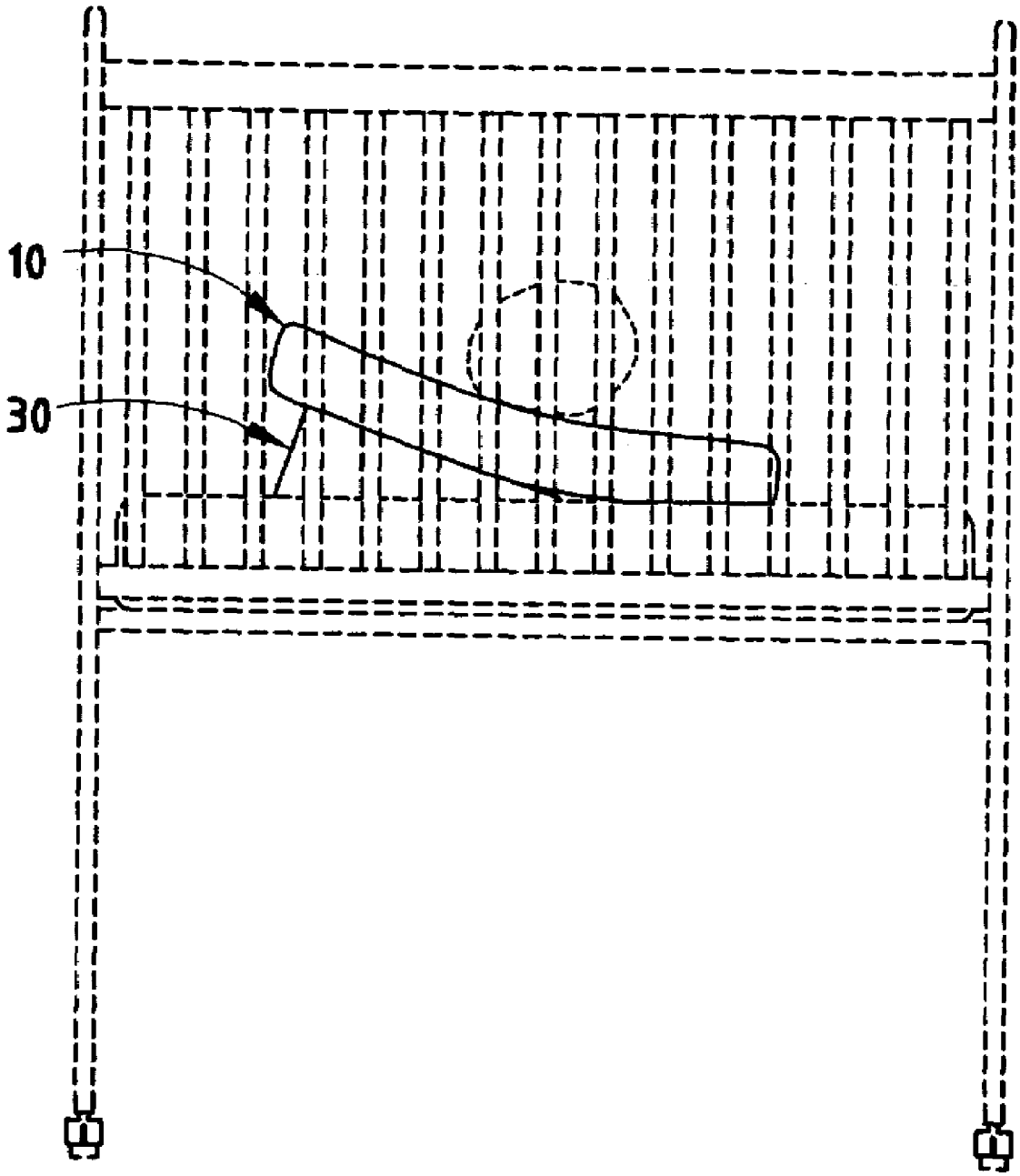
FIG. 7 is an end view of the system of FIG. 2 positioned within a crib.

As shown in FIG. 7, the system may be incorporated into a crib, cribette, cradle, bassinette, or any other structure in which an infant is typically placed in a generally horizontal position for an extended period of time.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A system for the prevention of positional plagiocephaly comprising:

an infant receiving member comprising an infant supporting surface, a first portion, and a second portion;

an inclined member comprising a generally V-shaped member having a first substantially pointed end and a second substantially truncated end wherein the generally V-shaped member comprises a material wherein the material is selected from the group consisting of foam, metal, wood, and plastic and wherein the inclined member is positioned at least partially under the first or second portion of the infant receiving surface such that the first or second portion of the infant receiving surface is inclined.

2. The system of claim 1, wherein the first portion and the second portion define an infant receiving region located substantially adjacent the second portion and the first portion of the infant receiving member and the system further comprises an infant retaining device adapted to retain an infant at the infant receiving region of the infant receiving member.

3. The system of claim 2, wherein the infant receiving member comprises a mattress.

4. The system of claim 3, wherein the infant retaining device comprises a three point harness.

5. The system of claim 4, wherein the three point harness comprises a first strap and a second strap which laterally wrap over the torso of an infant and engage one another and a third strap substantially longitudinally wrapping over the torso of an infant and engaging the first or second strap thereby securing an infant.

6. The system of claim 5, wherein the mattress comprises a generally rectangular foam material.

7. The system of claim 6, wherein the infant receiving member further comprises an inclined member engaging surface comprising a hook and loop style attachment system and the inclined member comprises the other of the hook or the loop attachment system whereby the hook and loop attachment system operate to at least partially engage the inclined member to the infant receiving member.

8. The system of claim 3, wherein the infant retaining device comprises a harness.

9. The system of claim 1, wherein the infant receiving member comprises at least one pocket for receiving the inclined member.

10. The system of claim 1, wherein the inclined member is permanently formed to the infant receiving member.

11. A system for the prevention of positional plagiocephaly comprising:

a generally rectangular foam mattress comprising a first portion, a second portion, an infant receiving region located substantially adjacent the second portion and the first portion of the mattress, and a harness adapted to retain an infant in the infant receiving region of the mattress; and a foam wedge adapted to be positioned at least partially under either the first portion or the second portion of the mattress such that an infant's head is directed to lay in different substantially lateral positions when the wedge is at least partially positioned under the first portion and when the wedge is at least partially positioned under the second portion.

12. The system of claim 11, wherein the harness comprises a three point harness comprising a first strap and a second strap which laterally wrap over the torso of an infant and engage one another and a third strap substantially longitudinally wrapping over the torso of an infant and engaging the first or second strap thereby securing an infant.

13. The system of claim 12, wherein the mattress further comprises a wedge engaging surface comprising a hook and loop style attachment system and the wedge comprises the other of the hook or the loop attachment system whereby the hook and loop attachment system operate to at least partially engage the wedge to the mattress.

14. The system of claim 12, wherein the mattress comprises at least one pocket for receiving the wedge.

15. The system of claim 14, wherein the mattress comprises at least two pockets for receiving the wedge, at least one positioned in the first portion and at least one positioned in the second portion of the mattress.

16. A method for the prevention of positional plagiocephaly comprising:

providing an infant receiving member comprising an infant supporting surface, a first portion, a second portion, an infant receiving region located substantially adjacent the second portion and the first portion of the infant receiving member, and an infant retaining device adapted to retain an infant at the infant receiving region of the infant receiving member and an inclined member;

positioning the infant receiving member on a generally horizontal surface;

positioning the inclined member at least partially under the first portion of the infant receiving device, thereby at least partially tilting the first portion of the infant receiving device;

positioning an infant in the infant retaining device whereby the tilt of the first portion farces the infant's head into a first position; and securing the infant in the infant retaining device.

17. The method of claim 16 further comprising the steps of:

positioning the inclined member at least partially under the second portion of the infant receiving device thereby at least partially tilting the second portion of the infant receiving device;

positioning the infant in the infant retaining device whereby the tilt of the second portion forces the infant's head into a second position; and securing the infant in the infant retaining device.

18. The method of claim 16, wherein the infant receiving member comprises a mattress.

19. The method of claim 18, wherein the infant retaining device comprises a harness.

20. The method of claim 18, wherein the infant retaining device comprises a three point harness.

21. The method of claim 19, wherein the infant receiving member further comprises an inclined member engaging surface comprising a hook and loop style attachment system and the inclined member comprises the other of the hook or the loop attachment system whereby the hook and loop attachment system operate to at least partially engage the inclined member to the infant receiving member.

22. The method of claim 16, wherein the inclined member comprises a generally V-shaped member comprising a first substantially pointed end and a second substantially truncated end.

23. The method of claim 22, wherein the generally V-shaped member comprises a foam wedge.

24. The method of claim 22, further including:

providing the infant receiving member with at least one pocket for receiving the inclined member.

25. The method of claim 16, further including:

providing an inclined member which is permanently formed to the infant receiving member.

26. A method for the prevention of positional plagiocephaly comprising:

providing a mattress comprising an infant supporting surface, a first portion, a second portion, an infant receiving region located substantially adjacent the second portion and the first portion of the mattress, and a harness adapted to retain an infant at the infant receiving region and a generally V-shaped inclined member;

positioning the mattress on a generally horizontal surface;

positioning the inclined member at least partially under the first portion of the mattress, thereby at least partially tilting the first portion of the mattress;

positioning an infant in the harness whereby the tilt of the first portion urges the infant's head into a first lateral position; and securing the infant in the harness.

27. The method of claim 26, further comprising the steps of:

positioning the inclined member at least partially under the second portion of the mattress thereby at least partially tilting the second portion of the mattress;

positioning the infant in the harness whereby the tilt of the second portion urges the infant's head into a second lateral position; and securing the infant in the harness.

28. The method of claim 26, wherein the infant retaining device comprises a three point harness.

29. The method of claim 26, wherein the generally V-shaped member comprises a foam wedge.

30. The method of claim 26, further including:

providing the infant receiving, member with at least one pocket for receiving the inclined member.

31. The method of claim 26, further including:

providing an inclined member which is permanently formed to the infant receiving member.

* * * * *